United States Patent [19]

Tobias

[11] 4,215,624

[45] Aug. 5, 1980

[54] AXIAL PISTON HYDRAULIC PUMPS OR MOTORS WITH IMPROVED VALVING

[75] Inventor: Jaromir Tobias, New York, N.Y.

[73] Assignee: American Hydraulic Propulsion Systems, Inc., Englewood, N.J.

[21] Appl. No.: 895,645

[22] Filed: Apr. 12, 1978

[51] Int. Cl.[2] ..... F01B 13/04

[52] U.S. Cl. ..... 91/499

[58] Field of Search ..... 91/472, 499, 503, 505

[56] References Cited

U.S. PATENT DOCUMENTS

| | | | |
|---|---|---|---|
| 1,822,064 | 9/1931 | Sorensen | 91/507 |
| 2,169,456 | 8/1939 | Wahlmark | 91/475 |
| 3,279,390 | 10/1966 | Horlacher | 91/472 |
| 3,548,719 | 12/1970 | Tobias | 91/498 |

FOREIGN PATENT DOCUMENTS

| | | | |
|---|---|---|---|
| 665443 | 12/1928 | France | 91/505 |
| 532635 | 1/1941 | United Kingdom | 91/503 |

*Primary Examiner*—William L. Freeh
*Attorney, Agent, or Firm*—Brumbaugh, Graves, Donohue & Raymond

[57] ABSTRACT

The conventional slotted valve plate of an axial piston pump-motor is replaced by an integral or separate barrel extension having a charge-discharge passageway leading to each cylinder. The passageways lead axially from the cylinders and then turn generally radially inward to open at ports in a circular-cylindrical bore in the extension which is coaxial with the barrel and main shaft axis. The end of a fixed pintle shaft extends into the bore. The pintle shaft has fluid supply and return passages that open to charge and discharge areas within the bore which, in turn, communicate through ports in the shaft with the ports in the barrel. The charge and discharge areas are divided by a diametrical wall, and bridges at the edges of the wall and between the pintle shaft ports serve as valves which sequentially close each barrel port and thereby separate the charge and discharge stages of operation of each cylinder.

2 Claims, 7 Drawing Figures

AXIAL PISTON HYDRAULIC PUMPS OR MOTORS WITH IMPROVED VALVING

BACKGROUND OF THE INVENTION

The present invention relates to axial piston hydraulic pumps and motors and, in particular, to improved charge-discharge valving between the main fluid inlet-outlet couplings and the cylinders.

In a widely used standard design of axial-piston hydraulic pump-motors, the cylinder barrel is keyed to a main shaft which extends the full length of the machine and is journaled in both ends of the housing. A swash plate is connected by a universal joint to the shaft, is suitably coupled to the piston rods, such as by balls and sockets, and bears against an adjustable thrust and radial bearing assembly.

Fluid is charged to and discharged from the cylinders through ports in the outer end of the barrel which sweep across semi-annular slots in a valve plate on the end wall of the housing. The design of the cylinder ports and the valve plate is critical; the design objective is to maintain a fluid pressure on the land areas of the valve plate and barrel which will approximately balance a pressure exerted on the ends of the cylinder bores in the direction toward the valve plate, thus to ensure maintenance of a pressurized fluid film between the rotating barrel and the fixed valve plate throughout the range of working pressures of the machine while minimizing leakage at the valve plate. This design principle is reasonably effective when properly executed in respect of both the engineering and precision manufacturing of the machine, but excellence is difficult to attain and the failure to achieve it can greatly reduce machine efficiency and increase machine failure rates. Moreover, the conventional valving design inherently requires a reduction in cross-sectional area along the path between the main fluid inlet and outlet ports, specifically at the ends of the cylinder bores, to generate a hydraulic force on the barrel acting toward the valve plate. (Note that the barrel is movable axially on the main shaft). The constriction in the flow path to and from each cylinder produces turbulence, energy-consuming pressure changes and, under some conditions, especially on the intake stroke in the pump mode, cavitation. Turbulence is an energy loss, or more accurately, an energy exchange almost always lost as heat that must be removed from the system. The pressure changes at the constrictions in the flow paths reduce volumetric efficiency. Cavitation produces harmful cavitation corrosion, thus reducing machine life, increases noise, and limits operating speed and, therefore, horsepower for a given displacement.

The design of conventional ports and valve plates is largely impirical and imprecise; the effects of friction, displacement and speed adjustments and changes in operation, a change from motor to pump mode, scale-up or scale-down, and many other factors affect the design parameters and make perfection of a given design costly. The hydraulic force on the barrel that maintains the pressure balance seal at the valve plate is inherently unbalanced (asymetrical with respect to the barrel axis) and provides a non-uniform sealing effect due to the pressure differences at the barrel-plate interface. Practical operation outside fairly tight operating specifications can significantly reduce efficiency or result in breakdown.

SUMMARY OF THE INVENTION

There is provided, in accordance with the present invention, an improved fluid charge-discharge part of an axial piston hydraulic pump-motor which permits substantial increases in horsepower per unit weight, in efficiency, and in reliability and affords operation in broader ranges of speed, displacement and pressure, all at lower engineering and manufacturing costs. The troublesome conventional valve plate is eliminated, and the pressure balance principle, which requires the barrel to be shiftable axially and area reductions to be provided in the entrances to the cylinders adjacent the valve plate, is not applicable.

The invention includes an integral or separate axial extension on the outer end of the cylinder barrel having for each cylinder a charge-discharge passage communicating with the cylinder at one end and opening at the other end at a port in an internal circular cylindrical bore within the extension which is coaxial with the main shaft and receives the end of a pintle shaft. The pintle shaft is mounted on the end wall of the housing and has separate inlet-outlet passages which open to supply-discharge areas on opposite sides of a diametrical wall which separates the high and low pressure sides. The supply-discharge areas, in turn, are open radially through pintle ports which conform to the bands swept by the barrel ports in the barrel extension but are separated by diametrically opposite bridges at either side of the divider wall. The bridges constitute valves which close each barrel port as it passes over them, thus to separate the cylinder charge and return stages of each cycle of each cylinder.

The cross-sectional area of each of the charge-discharge passages in the barrel is, preferably, substantially uniform throughout its length and substantially equal to that of the cylinder it serves, but those characteristics are not essential to effective use of the invention insofar as reducing manufacturing costs and improving machine operation are concerned. The advantages of doing away with the valve plate are numerous. There are added advantages derived from eliminating or reducing pressure changes, turbulence and cavitation.

More particularly, cavitation and turbulence resulting from pressure and velocity changes limit maximum speed; for a given displacement and pressure, speed is the only variable left to affect horsepower, and a speed limit means a horsepower limit. By substantially eliminating velocity and pressure changes in the flows to and from the cylinders, i.e., by making the area of each passage uniform and equal to the area of the cylinder, higher operating speeds, which mean greater horsepower for a given displacement and pressure, are attainable. This means, in turn, that a given horsepower can be delivered by a higher speed machine of much smaller displacement, size and weight or a unit of a given displacement, size and weight can be operated at a higher speed and thus deliver greater horsepower. Optimum designs embodying the invention should enable maximum horsepower-to-displacement ratios three to four times those attainable with previously known axial piston hydraulic pump-motors.

Any of the porting configurations described and shown in Tobias U.S. Pat. Nos. 3,345,916 and 3,548,719 (issued Oct. 10, 1967 and Dec. 22, 1970, respectively) or in Tobias pending application Ser. No. 858,561, filed Dec. 8, 1977, now U.S. Pat. No. 4,161,906, can be used to advantage in the barrel ports of the present invention;

those configurations permit the number of ports to be increased without increasing the size of the bore or reducing the areas of the ports in that the ports are axially lengthened and circumferentially shortened in size, relative to the cylinder diameter, thus to maintain a constant area. With low flow rates, there is little difference in effectiveness between the three, but at high flow rates, the porting and the surfacing of the passages in the pintle shaft of the application are preferred. Reference should be made to the patents and application for detailed information concerning porting and surface configurations. Each passage in the barrel may also have two or more generally radial branches, each of which opens to the bore at a separate port.

It is preferable that the cylinder barrel be supported by journal and thrust bearings on the inner or blind end of the pintle shaft and between the end of the barrel and the housing; additional bearings between the barrel circumference and the housing may also be provided, as is conventional in many existing designs.

Effective sealing between the cylinder barrel and the pintle shaft involves a bearing-fit tolerance between the shaft and bore adjacent the ports. Such a fit permits controlled leakage for thin fluid film lubrication purposes. Capillary grooves running lengthwise of the lands of the pintle shaft enchance sealing without adversely affecting lubrication, apparently by generating very high turbulence in the film near the grooves (see Tobias U.S. Pat. No. 3,636,819, issued Jan. 25, 1972).

Among the important advantages of the invention are the following:

(1) the difficulties and high costs of engineering and manufacturing effective valve plates based on the pressure balance concept are eliminated;

(2) the sealing and lubrication of the interfaces between the barrel and pintle are highly predictable and reliable over a wide range of speeds and pressures;

(3) the cylindrical surfaces of the pintle shaft and the bore of the barrel are easy to manufacture and assemble with high precision;

(4) the mounting of the outer end of the cylinder barrel on thrust and journal bearings on the pintle shaft and housing ensures true running of the barrel relative to the pintle;

(5) in the case of pumps, the fluid supply may be at atmospheric pressure, which is usually impossible in prior art pumps of this type;

(6) smooth, relatively non-turbulent flow and, therefore, minimal pressure drop and turbulence losses, are afforded;

(7) the speed (horsepower) barrier of known designs is broken—maximum horsepower-to-displacement ratios of three or four times those practical with known designs should be attainable;

(8) the costly precision machining of various parts to ensure trueness of the valve plate to the end of the barrel are eliminated—the barrel is journaled to run true to easily machined cyclindrical surfaces of the barrel and pintle shaft.

For a better understanding of the invention, reference may be made to the following description of exemplary embodiments, taken in conjunction with the accompany drawings.

DESCRIPTION OF THE EMBODIMENTS

Figure 1:
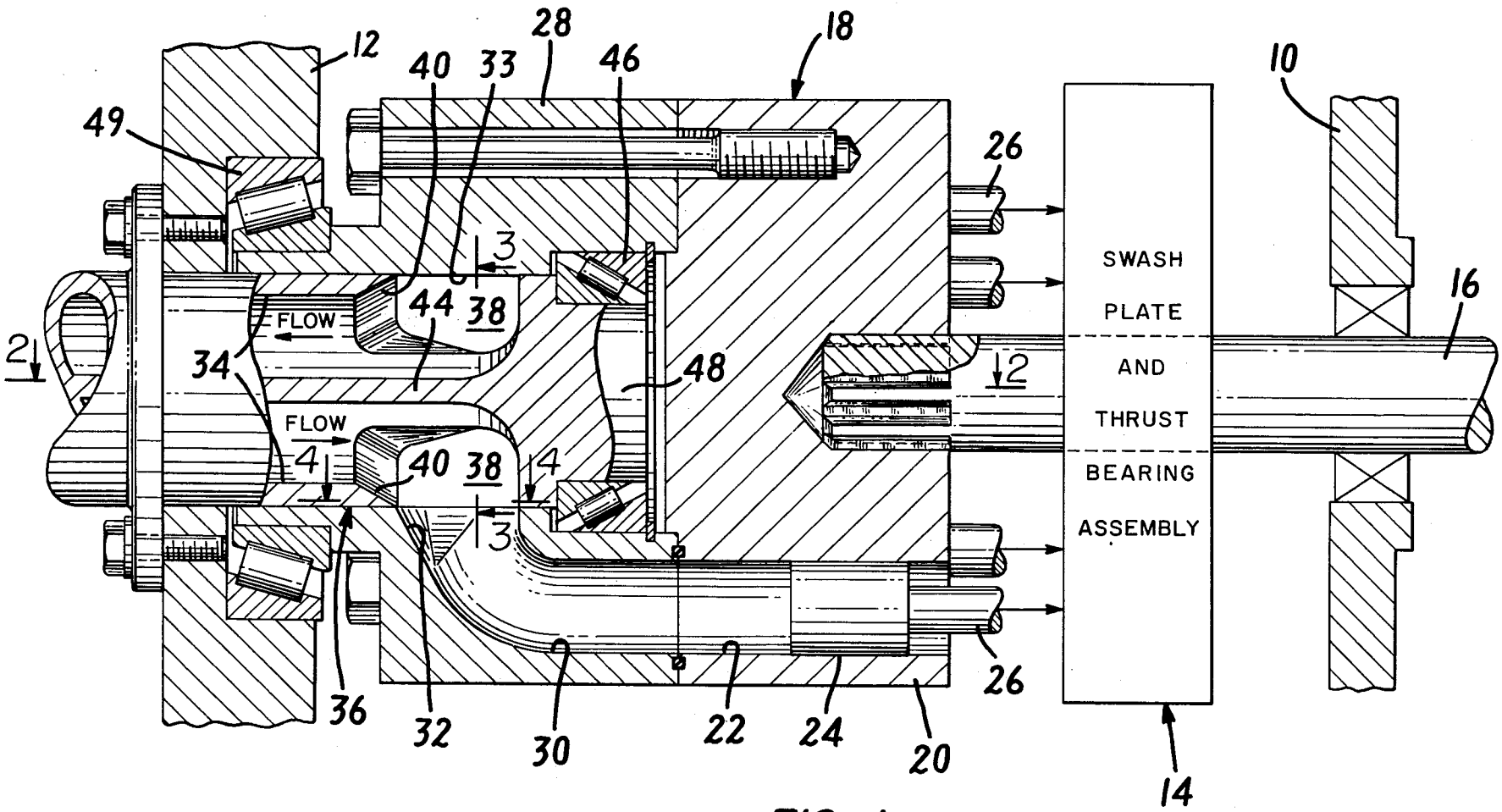
FIG. 1 is a side cross-sectional view of one embodiment, parts of which are depicted schematically.
Figure 2:
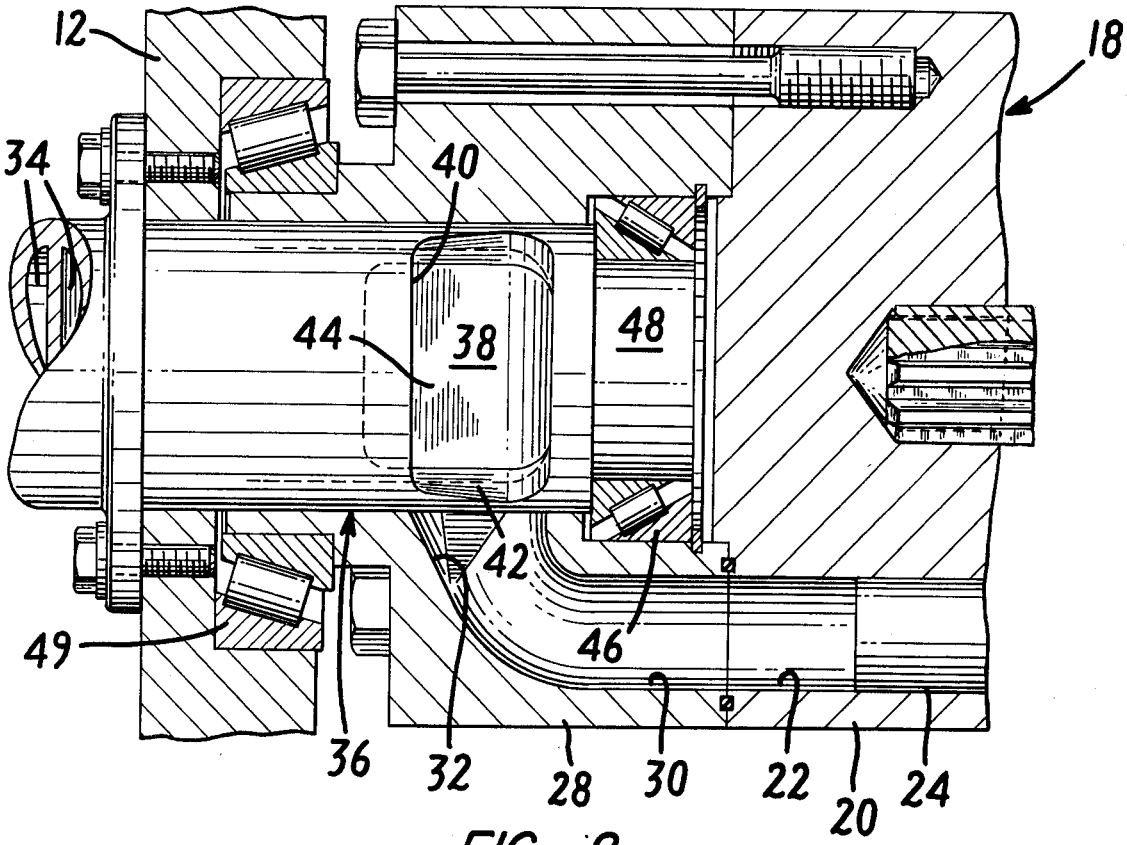
FIG. 2 is a top cross-sectional view of part of the embodiment of FIG. 1 taken along the lines 2—2 of FIG. 1.
Figure 3:
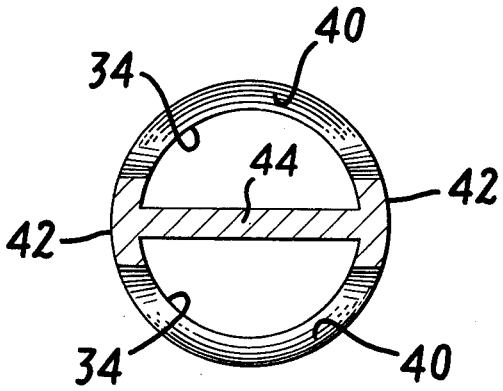
FIG. 3 is an end cross-sectional view of the pintle shaft of the embodiment of FIGS. 1 and 2 (see the lines 3—3 of FIG. 1)
Figure 4:
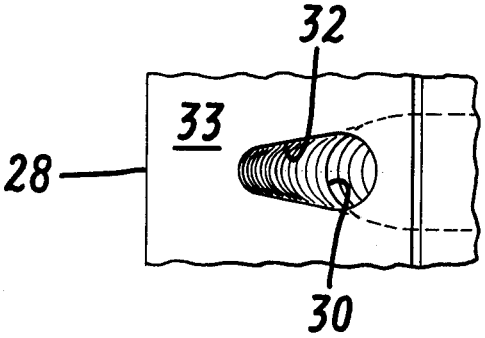
FIG. 4 is a developmental view of a port in the barrel (see the lines 4—4 of FIG. 1)

As discussed above, the present invention is concerned primarily with the fluid supply of an axial piston pump-motor. Accordingly, many details of the construction of the embodiments, such as the housing, the swash plate and thrust bearing assembly, the piston rods and linkages, and main shaft bearing are depicted schematically; such details are well-known in many forms in the art and can be adopted in conjunction with the invention as a matter of ordinary engineering skill.

The embodiment of FIGS. 1 to 4 includes a housing having end plates 10 and 12, a swash plate and thrust bearing assembly 14 of any suitable construction, and a main shaft 16 journaled in one end plate. Ordinarily, the main shaft of known axial piston hydraulic pump-motors extends the full length of the housing and is journaled at both ends, and the barrel is keyed to the shaft but can move lengthwise on it. According to the present invention, the main shaft 16 is journaled at only one end, and the barrel 18 is joined to rotate with it, such as by a splined coupling as shown.

The barrel 18 consists of a main or body portion 20 having several (preferably, an uneven number) axially extending cylinders 22 spaced equidistant from each other and equidistant from the axis of the main shaft. Each cylinder receives a piston 24 which is connected by a piston rod 26 to the assembly 14 through universal couplings. The barrel also includes a valve extension 28 which is either unitary with or a separate part bolted to the body (as shown); the latter arrangement is easier to manufacture and can also be used to advantage in reworking existing designs (as discussed below). The barrel extension has charge-discharge passageways 30—one for each cylinder 22—which lead back from the cylinders and then turn inwardly where they open through ports 32 in the wall of an internal cylindrical bore 33. Each passageway, preferably, is of substantially uniform cross-sectional area along its length, and that area is, in turn, substantially equal to that of each cylinder, thus essentially to eliminate cavitation and turbulence due to pressure and velocity changes. The ports have maximum circumferential dimensions less than the cylinder diameter and axial dimensions greater than the cylinder diameter; this permits the bridges of the pintle shaft (described below) to be made narrower (circumferentially) and the size of the bore 33 in the barrel to be reduced, and all other things being equal, shortens the valve closing times for each cylinder to the enhancement of efficiency.

Fluid flows to and from the passages through supply and return passages 34 in a pintle shaft 36 which is affixed to the end plate 12 and extends in bearing clearance into the bore. The passages 34 open into charge-discharge areas 38 adjacent the blind end of the pintle shaft, which in turn open through ports 40 which are coextensive generally with the zone or band of the pintle shaft swept by the ports 32 in the barrel but are separated by bridges 42 at each side of a diametrical wall 44 of the pintle shaft that separates the charge and discharge areas.

From a study of the patents and application referred to above, the foregoing description and the drawings annexed to this specification, it is apparent that the valving, sealing and fluid flow characteristics described in the prior patents and application and the structures yielding such characteristics are applicable to the present invention. Accordingly, those patents and that application are incorporated herein by reference in lieu of an extended description here of the porting configurations and the sealing at the interface between the pintle shaft and the bore of the barrel.

The valve end of the barrel is supported and stabilized axially and in rotation by a journal-thrust bearing 46 mounted on a boss 48 on the blind end of the pintle shaft and a journal-thrust bearing 49 on the housing. Assuming that the main shaft bearing is not a thrust bearing, the bearing 49 must carry the net reaction force in the axial direction of the pistons and should be designed accordingly.

Figure 5:
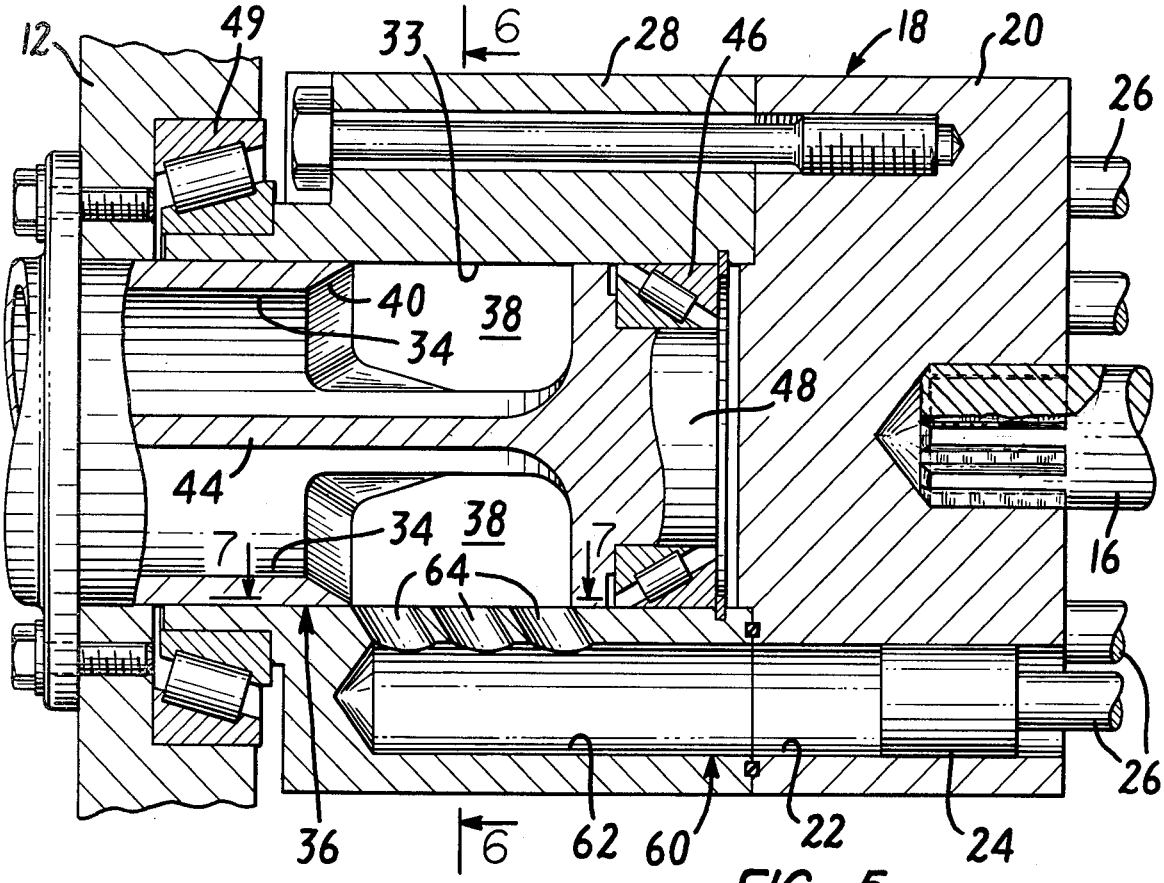
FIG. 5 is a side cross-sectional view of part of a second embodiment of the invention.
Figure 6:
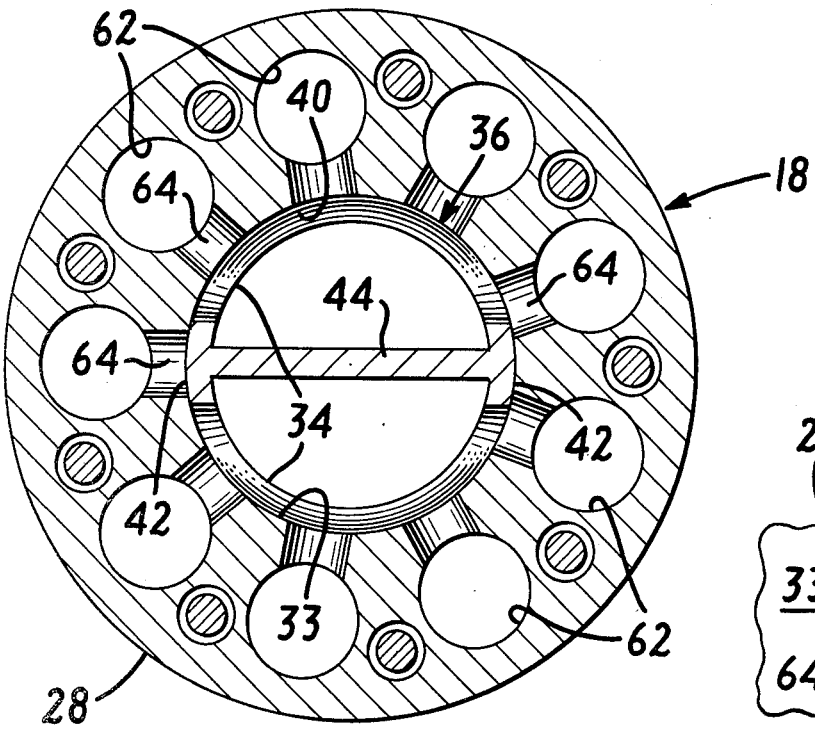
FIG. 6 is an end cross-sectional view of the embodiment of FIG. 5 taken along the lines 6—6 of FIG. 5.
Figure 7:
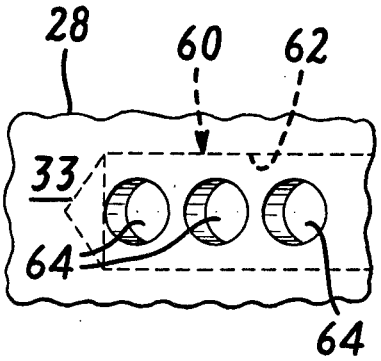
FIG. 7 is a developmental view of the ports of one passage in the barrel of the embodiment of FIGS. 5 and 6 (see the lines 7—7 of FIG. 5).

The embodiment of FIGS. 5 to 7 is in most respects identical to that of FIGS. 1 to 4; where applicable, the same reference numbers used above designate corresponding parts. The main difference is in the design of the passages and exists principally to facilitate manufacture and thus reduce costs. Each passage 60 includes an axial portion 62 formed by drilling from the cylinder end into the barrel extension and three generally radial branches 64 drilled and plugged from outside (not shown) or formed from within the bore (as shown); the branches 64 can be drilled by long bits inserted into the bore at an angle to the axis of the barrel. The relatively small diameters of the branches 64 (compared to the cylinder diameters) allow the widths of the bridges of the pintle shaft and the overall diameter of the pintle shaft to be kept low. Two, three, four or more radial branches serving the axial portion of each passage permit the total transverse cross-sectional area of the branches to be kept substantially equal to the cross-sectional area of the axial portion and the cylinder while accommodating a small-diameter pintle shaft and narrow land areas.

In the motor mode of operation, hydraulic fluid is delivered through one of the passages 34 of the pintle shaft under high pressure, flows through the charge-discharge passages 30 or 60 open at the time to the pintle shaft ports 40, and forces the pistons 24 out of the cylinders 22. The pistons drive the swash plate 14 in rotation. Meanwhile, the swash plate forces the pistons on the low pressure, return side back into the cylinders to return fluid back through the passages to a reservoir or in a closed (positive) system back to the pump (not shown). The bridges 42 of the pintle shaft briefly close each port 32 or 64 (see the 9:00 o'clock position of FIG. 6, for example) between the high perssure, working side and the low pressure, return side of the motor.

Operation in the pump mode is the same as in the motor mode except that the input is mechanical rotation of the main shaft and barrel which forces reciprocation of the pistons as they work against the swash plate to draw fluid in on the "out" stroke and force it out under pressure against a load on the "in" stroke. Both the pump and motor modes are reversible and adjustable, as is well known.

The valving provided according to the invention improves efficiency by reducing leakage at the valve and by virtually eliminating cavitation and turbulence due to area changes in the passages and cylinders. The turbulent fluid seals at the bridges are substantially unaffected by pressure changes and other variables. Important cost savings accrue from simpler construction, elimination of some precision machining and reductions in size and weight for a given displacement. Higher operating speeds and, therefore, horsepower are attainable without the much higher costs normally required.

The invention is well suited for redesigns and rebuilds of existing machines; accordingly, much existing tooling and engineering in the industry can be saved. Reworking of the main shaft, barrel and the housing end plate at the hydraulic end and the addition of the barrel extension and pintle shaft will often be all that is required to convert present machines. Most of the housing, the swash plate and thrust bearing, the barrel, pistons and piston rods can, with little or no change, be retained.

I claim:

1. In an axial piston hydraulic pump or motor which includes a rotatable cylinder barrel having a multiplicity of axially extending cylinders spaced apart circumferentially from each other and radially from the axis of a main shaft on which the barrel is mounted, the improvement comprising an internal circular cylindrical bore in the barrel, the bore being coaxial with the axis of the main shaft, a multiplicity of charge-discharge passages in the barrel, one such passage communicating with each cylinder at one end and opening at the other end through at least two ports in the circumferential wall of the bore, and each such passage being of substantially uniform cross-sectional area along its entire length from the ports to the cylinders, which area is substantially equal to the cross-sectional area of the corresponding cylinder, a non-rotatable pintle shaft received in the bore, the pintle shaft having supply and return passages opening to charge and discharge areas which communicate through charge and discharge ports in the circumferential wall of the shaft that are substantially coextensive with the zones swept by the ports in the barrel and are separated by diametrically opposite bridges which serve as valves to open and close sequentially communication between the respective charge and discharge ports in the pintle shaft and each port in the bore of the barrel to separate the charge and discharge stages of each cycle of operation of each cylinder, a journal-thrust bearing interposed between the pintle shaft and cylinder barrel for rotatably supporting and stabilizing the barrel on the pintle shaft and a journal-thrust bearing interposed between the barrel and a housing member adjacent the end of the barrel remote from the main shaft, whereby true running of the barrel on the pintle is ensured for effective sealing and lubrication of the interfaces between the barrel and pintle.

2. The improvement according to claim 1, wherein each of the ports of the charge-discharge passages has an axial dimension substantially greater than the diameter of the cylinders and a circumferential dimension substantially less than the diameter of the cylinders.

* * * * *